US008733100B2

(12) United States Patent
Christmann

(10) Patent No.: US 8,733,100 B2
(45) Date of Patent: May 27, 2014

(54) VALVE CONTROL DEVICE

(75) Inventor: Ralf Christmann, Kaiserslautern (DE)

(73) Assignee: BorgWarner Inc., Auburn Hills, MI (US)

( * ) Notice: Subject to any disclaimer, the term of this patent is extended or adjusted under 35 U.S.C. 154(b) by 981 days.

(21) Appl. No.: 12/519,593

(22) PCT Filed: Oct. 24, 2007

(86) PCT No.: PCT/EP2007/009234

§ 371 (c)(1),
(2), (4) Date: Jun. 17, 2009

(87) PCT Pub. No.: WO2008/083770

PCT Pub. Date: Jul. 17, 2008

(65) Prior Publication Data

US 2010/0101225 A1 Apr. 29, 2010

(30) Foreign Application Priority Data

Dec. 22, 2006 (DE) ..... 10 2006 062 276

(51) Int. Cl.
*F02D 23/00* (2006.01)

(52) U.S. Cl.
USPC ..... 60/602; 92/151; 92/98 D; 92/130 A

(58) Field of Classification Search
USPC ..... 60/602; 123/406.67, 406.73, 568.27, 123/568.29; 139/907; 251/61, 61.2; 92/151, 92/98 D, 130 A
See application file for complete search history.

(56) References Cited

U.S. PATENT DOCUMENTS

| | | | | | |
|---|---|---|---|---|---|
| 2,985,196 | A | * | 5/1961 | Brunner | 92/94 |
| 3,433,132 | A | * | 3/1969 | James | 92/48 |
| 3,618,582 | A | * | 11/1971 | Gerlitz et al. | 123/198 DB |
| 3,752,450 | A | * | 8/1973 | Charron et al. | 261/39.1 |
| 4,069,798 | A | * | 1/1978 | Thornburgh | 123/568.29 |
| 4,075,849 | A | * | 2/1978 | Richardson | 60/602 |
| 4,196,707 | A | * | 4/1980 | Stoltman | 123/568.27 |
| 4,202,524 | A | * | 5/1980 | Brakebill | 251/28 |
| 4,211,081 | A | * | 7/1980 | Yamada | 60/602 |
| 4,272,959 | A | * | 6/1981 | Yamane | 60/602 |

(Continued)

FOREIGN PATENT DOCUMENTS

| | | | |
|---|---|---|---|
| DE | 10025877 | A1 | 12/2001 |
| EP | 0047399 | A2 | 3/1982 |

(Continued)

*Primary Examiner* — Thomas Denion
*Assistant Examiner* — Patrick Maines
(74) *Attorney, Agent, or Firm* — William G. Anderson; Stephen A. Pendorf; Patent Central LLC

(57) ABSTRACT

The present invention relates to a valve control device (1) having a housing (2), which comprises a first low pressure chamber (3) and a first atmospheric pressure chamber (4), which are separated from each other in a gas-tight manner by means of a spring-loaded first membrane (5); having a control rod (6) for controlling the position of a locking element of the bypass valve (7), wherein the control rod (6) is operatively connected to the first membrane (5), further having a second low pressure chamber (8), which is flow-connected to the first low pressure chamber (3), and having a second spring-loaded membrane (9), which is arranged in the second low pressure chamber (8) and is coupled to the first membrane (5), wherein the control rod (6) is mounted on the second membrane (9).

20 Claims, 1 Drawing Sheet

(56) References Cited

U.S. PATENT DOCUMENTS

| | | | | | |
|---|---|---|---|---|---|
| 4,283,912 | A | * | 8/1981 | Cholvin | 60/602 |
| 4,311,008 | A | * | 1/1982 | Yamada | 60/602 |
| 4,351,285 | A | | 9/1982 | Bradshaw | |
| 4,364,368 | A | * | 12/1982 | Blanchette | 123/568.29 |
| 4,365,608 | A | * | 12/1982 | Bradshaw et al. | 123/568.29 |
| 4,409,945 | A | * | 10/1983 | Rachedi | 123/568.29 |
| 4,549,470 | A | * | 10/1985 | Yogo | 92/94 |
| 4,791,906 | A | * | 12/1988 | Ecomard | 123/564 |
| 5,063,744 | A | * | 11/1991 | Ishiyama et al. | 60/600 |
| 5,067,470 | A | * | 11/1991 | Panten et al. | 123/568.29 |
| 5,163,471 | A | * | 11/1992 | Powell | 137/494 |
| 5,507,308 | A | * | 4/1996 | Chambonnet | 137/81.2 |
| 6,968,742 | B2 | * | 11/2005 | Rodenhauser et al. | 73/706 |

FOREIGN PATENT DOCUMENTS

| | | | |
|---|---|---|---|
| FR | 1277169 | A | 11/1961 |
| GB | 2068455 | A | 8/1981 |
| GB | 2076940 | A | 12/1981 |

* cited by examiner

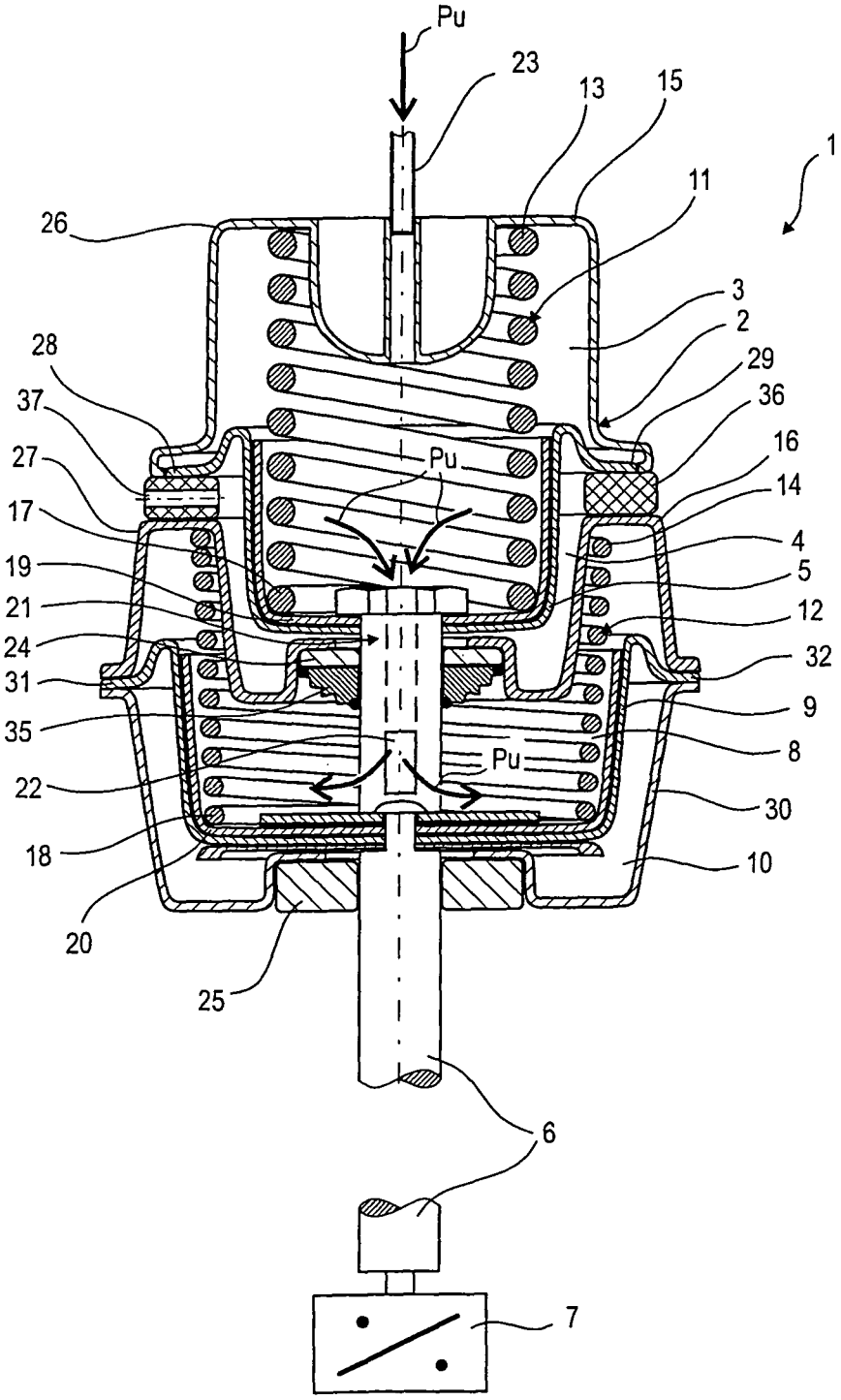
Pu
23
13
15
1
11
26
3
2
28
29
37
36
16
27
Pu
14
17
4
19
5
21
12
24
32
31
9
35
8
Pu
22
30
18
10
20
25
6
7

VALVE CONTROL DEVICE

The invention relates to a valve control device as per the preamble of claim 1.

A control device of said type is known from EP 1 491 754 A1. Control devices of said type, which are also referred to as control capsules, have a vacuum chamber which is arranged in a housing and which is connected to a vacuum source, for example to the vacuum pump of an engine. A diaphragm is arranged in said vacuum chamber, which diaphragm is preloaded in one direction by a spring. The diaphragm separates the vacuum chamber from a second pressure chamber which may be connected to the atmosphere or to a further vacuum source. The diaphragm is connected to a regulating rod which in turn actuates the shut-off element of the bypass valve. For this purpose, a vacuum is built up in the vacuum chamber, as a result of which vacuum the diaphragm is deformed counter to the spring force, and the regulating rod is thereby moved.

For the application of large forces, however, large diaphragm surfaces are required, since the magnitude of the vacuum which can be applied is limited. This in turn entails large diameters of the diaphragms, which ultimately entails a large installation space.

It is therefore an object of the present invention to create a control device of the type specified in the preamble of claim 1 which makes it possible to apply large forces to the regulating rod and simultaneously permits a compact design.

Said object is achieved by means of the features of claim 1.

The control device according to the invention, which may also be referred to as a "two-chamber capsule" on account of the provision of two vacuum chambers, permits an increase in the effective diaphragm surface, since on account of the design according to the invention the diaphragm surfaces of the two vacuum chambers are added, since as a result of the internal pressure compensation of the application of a vacuum in both vacuum chambers the same direction of action for the deformation of the diaphragm is obtained. For this purpose, the vacuum which is applied to the one vacuum chamber is also generated in the other vacuum chamber as a result of the flow connection which is provided, the diaphragm of which other vacuum chamber is connected to the regulating rod.

The control device according to the invention may in principle be used for any type of valves, but in particular for activating turbocharger exhaust-gas bypass valves, exhaust-gas recirculation valves and valves with which fresh air can be controlled.

The subclaims relate to advantageous refinements of the invention.

Further details, advantages and features of the present invention can be gathered from the following description of an exemplary embodiment on the basis of the drawing.

The single FIGURE shows a schematically slightly simplified sectioned illustration through a control device, or two-chamber capsule, according to the invention.

The control device 1 according to the invention serves for actuating bypass valves or the shut-off elements of such bypass valves, which are used in exhaust-gas turbochargers. In the FIGURE, the bypass valve is shown schematically as a block 7, which is operatively connected to the regulating rod 6 in order to actuate the bypass valve. Further details of the bypass valve and of the associated exhaust-gas turbocharger are however not illustrated, since said details are not important for the explanation of the present invention.

The control device 1 has a housing 2 in which, in the example, a first vacuum chamber 3 is arranged in the upper part. The first vacuum chamber 3 is separated from a first pressure chamber 4, which is under atmospheric pressure, by a spring-loaded first diaphragm 5.

The first vacuum chamber 3 is delimited by an upper housing part 26 and the pot-shaped first diaphragm 5, into which is inserted a likewise pot-shaped support part 19 on which is supported a lower end 17—in the selected illustration—of a pressure spring 11. The upper end 13 of said spring 11 is supported on an associated housing region 15 of the upper housing part 26.

The atmospheric pressure chamber 4 is delimited by the diaphragm 5 and a second housing part 27 which is situated below the upper housing part 26, with the diaphragm 5 being clamped, at its free peripheral end regions 28 and 29, by said two housing parts 26 and 27.

A second diaphragm 9 is in turn fixed, at its peripheral end regions 31 and 32, between the housing part 27 and a further housing part 30 which is provided in the illustrated embodiment and which, on account of the selected illustration, is situated at the bottom. Said second diaphragm 9 is arranged in a second vacuum chamber 8, with a pot-shaped support part 20 being inserted in turn into the diaphragm 9, with a second pressure spring 12 being supported via end regions 14 and 18 against the housing part 27 and against the support part 20.

As shown in the FIGURE, the regulating rod 6 is fixed to the lower diaphragm 9 and is also fixedly connected to a hollow screw 21 which, in the illustrated embodiment, constitutes an example for a flow connection between the first vacuum chamber 3 and the second vacuum chamber 8. The second vacuum chamber 8 is in fluid communication with the first vacuum chamber 3. Said hollow screw 21 has, upstream of its lower end in the region of the vacuum chamber 8, flow slots 22. Said flow slots form a connection between the two vacuum chambers 3 and 8, such that a vacuum which is applied by the vacuum source PU in the first vacuum chamber 3 can also be built up in the second vacuum chamber 8, as indicated by the arrows PU which are also provided in said chamber 8. As is also shown by the FIGURE, the hollow screw 21 is guided in an axially slidably movable fashion by a guide sleeve 24, and the regulating rod 6 is guided in an axially slidably movable fashion by a guide sleeve 25. For this purpose, the guide sleeves 24 and 25 are fixed in housing sections of the housing regions 27 and 30.

The guide sleeve 24 also has a sealing element 35 which, even in the event of the axial movement of the hollow screw 21, seals off the atmospheric chamber 4 with respect to the vacuum chamber 8 in a gas-tight fashion, for example by means of a diaphragm bellows.

The ventilation of the atmospheric pressure chamber 4 may for example be carried out by means of at least one opening 37 in an annular intermediate part 36 which bears directly against the upper end of the lower housing part 27, or is connected thereto or is integrated therein.

In addition to the above written disclosure of the invention, reference is hereby expressly made to the diagrammatic illustration of the invention in the appended FIGURE.

LIST OF REFERENCE SYMBOLS

1 Control device
2 Housing
3 First vacuum chamber
4 First atmospheric pressure chamber
5 First diaphragm
6 Regulating rod
7 Bypass valve
8 Second vacuum chamber
9 Second spring-loaded diaphragm

10 Second atmospheric pressure chamber
11, 12 Spring
13, 14 One end of the spring 11 or 12
15, 16 Housing regions
17, 18 Other end of the spring 11 or 12
19, 20 Support part
21 Hollow screw
22 Flow slots
23 Vacuum line
24 Sliding sleeve
25 Sliding sleeve
26 Upper housing part
27 Second housing part
28 End region
29 End region
30 Lower housing part
31 End region
32 End region
PU Vacuum source
35 Sealing element
36 Annular intermediate part
37 Ventilation opening

The invention claimed is:

1. A valve control device (1) comprising:

a housing (2) which has a first vacuum chamber (3) and a first atmospheric pressure chamber (4), which first vacuum chamber (3) and first atmospheric pressure chamber (4) are separated from one another in a gas-tight fashion by a spring-loaded first diaphragm (5);

a regulating rod (6) for regulating the position of a shut-off element of a bypass valve (7), with the regulating rod (6) being operatively connected to the first diaphragm (5), a second vacuum chamber (8) in fluid communication with the first vacuum chamber (3), and a second spring-loaded diaphragm (9) which is arranged in the second vacuum chamber (8), with the regulating rod (6) being fastened to the second diaphragm (9).

2. The control device as claimed in claim 1, further comprising a second atmospheric pressure chamber (10) which is separated from the second vacuum chamber (8) in a gas-tight fashion by the second diaphragm (9).

3. The control device as claimed in claim 1, wherein a sealing element is arranged between the first atmospheric pressure chamber (4) and the second vacuum chamber (8).

4. The control device as claimed in claim 1, wherein ventilation of the atmospheric pressure chamber (4) takes place by means of at least one opening (37) in an intermediate part (36).

5. The control device as claimed in claim 1, wherein in each case one spring (11 and 12) is provided for the spring-loading of the first and second diaphragms (5, 9) respectively, which spring (11 and 12 respectively) is supported at one end (13 and 14 respectively) on a respectively assigned housing region (15 and 16 respectively) and at the other end (17 and 18 respectively) on a support part (19, 20) which is arranged on the respective diaphragm (5, 9).

6. The control device as claimed in claim 5, wherein the spring forces of the springs (11, 12) which press against the first and second diaphragms (5, 9) respectively are of different sizes.

7. The control device as claimed in claim 5, wherein the spring (11 and 12), is a coil spring.

8. The control device as claimed in claim 1, wherein the fluid communication between the first and second vacuum chambers (3, 8) takes place by means of a hollow screw (21) which is provided with flow slots (22).

9. The control device as claimed in claim 8, wherein the regulating rod (6) is connected to the hollow screw (21).

10. The control device as claimed in claim 1, wherein the diaphragms (5, 9) have different diameters.

11. The control device as claimed in claim 1, wherein the fluid communication between the first and second vacuum chambers (3, 8) is achieved by a hollow element located within the valve control device.

12. The control device as claimed in claim 11, wherein the hollow member passes through the first atmospheric pressure chamber.

13. The control device as claimed in claim 11, wherein the hollow element is a hollow screw.

14. The control device as claimed in claim 13, wherein the hollow screw includes flow slots.

15. A turbocharger comprising:

a turbine which has a bypass with a bypass valve (7), a control device (1) for the bypass valve (7), which control device (1) has the following:

a housing (2) which has a first vacuum chamber (3) and a first atmospheric pressure chamber (4), which first vacuum chamber (3) and first atmospheric pressure chamber (4) are separated from one another in a gas-tight fashion by a spring-loaded first diaphragm (5); a regulating rod (6) for regulating the position of a shut-off element of the bypass valve (7), with the regulating rod (6) being operatively connected to the first diaphragm (5), a second vacuum chamber (8) in fluid communication with the first vacuum chamber (3), and a second spring-loaded diaphragm (9) which is arranged in the second vacuum chamber (8) with the regulating rod (6) being fastened to the second diaphragm (9).

16. The turbocharger as claimed in claim 15, further comprising a second atmospheric pressure chamber (10) which is separated from the second vacuum chamber (8) in a gas-tight fashion by the second diaphragm (9).

17. The turbocharger as claimed in claim 15, wherein the fluid communication between the first and second vacuum chambers (3, 8) is achieved by a hollow element located within the valve control device.

18. The turbocharger as claimed in claim 15, wherein the hollow member passes through the first atmospheric pressure chamber.

19. The turbocharger as claimed in claim 15, wherein the hollow element is a hollow screw that includes flow slots.

20. A valve control device (1) comprising:

a housing (2) having a first vacuum chamber (3) and a first atmospheric pressure chamber (4), the first vacuum chamber (3) and first atmospheric pressure chamber (4) being separated from one another in a gas-tight fashion by a spring-loaded first diaphragm (5);

a regulating rod (6) for regulating the position of a shut-off element of a bypass valve (7), the regulating rod (6) being operatively connected to the first diaphragm (5), a second vacuum chamber (8) in fluid communication with the first vacuum chamber (3) by a hollow screw (21) that includes flow slots (22), and a second spring-loaded diaphragm (9) which is arranged in the second vacuum chamber (8), with the regulating rod (6) being fastened to the second diaphragm (9).

* * * * *